United States Patent [19]

Ayash

[11] Patent Number: 4,771,360

[45] Date of Patent: Sep. 13, 1988

[54] GROUNDING BRUSH

[75] Inventor: Karl B. Ayash, Webster, N.Y.

[73] Assignee: Xerox Corporation, Stamford, Conn.

[21] Appl. No.: 28,374

[22] Filed: Mar. 20, 1987

[51] Int. Cl.[4] ..... H05F 3/02

[52] U.S. Cl. ..... 361/221

[58] Field of Search ..... 361/212, 214, 220, 221, 361/225; 250/324, 325, 326

[56] References Cited

U.S. PATENT DOCUMENTS 4,307,432 12/1982 Nishikawa ..... 361/221
4,352,142 9/1982 Uno ..... 361/221
4,402,593 9/1983 Bernard et al. ..... 361/212
4,494,166 1/1985 Billings et al. ..... 361/214
4,553,191 11/1985 Franks, Jr. et al. ..... 361/212

*Primary Examiner*—L. T. Hix
*Assistant Examiner*—Brian W. Brown
*Attorney, Agent, or Firm*—H. Fleischer; J. E. Beck; R. Zibelli

[57] ABSTRACT

A device which electrically grounds a component. The device includes a support member having a multiplicity of fibers mounted thereon. The support member has a plurality of spaced regions of reduced thickness to facilitate the breaking thereof. In this manner, a user may select a grounding device of any desired length.

14 Claims, 2 Drawing Sheets

GROUNDING BRUSH

This invention relates generally to an electrophotographic printing machine, and more particularly concerns a device for electrically grounding components employed therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, the various components thereof have to be electrically grounded rather than being allowed to float electrically. This is generally accomplished by connecting the components to an electrical ground. Numerous rollers are used in the printing machine to advance the copy sheet and the original document to their respective stations. These rollers must also be electrically grounded. Not only must rollers be electrically grounded, but shafts must also be electrically grounded. A separate grounding brush is employed for each roller and shaft. These grounding brushes are manufactured independently to the required length and installed in the printing machine to electrically ground the various components therein. Typically, a high volume commercial printing machine may require more than fifty such brushes at a cost of one dollar or more per brush. Hence, grounding brushes may cost as much as fifty dollars per machine. Today, the office copier market is highly competitive and costs are being continually driven downward. For example, if the cost of the grounding brush can be reduced by seventy five percent, grounding brushes will only contribute twelve dollars and fifty cents to the cost of the copier rather than fifty dollars Accordingly, it is highly desirable to be capable of manufacturing a grounding brush at significantly reduced cost.

Various types of electrical grounding brushes have been devised. The following patents appear to be relevant:

- U.S. Pat. No. 4,307,432, Patentee: Nishikawa, Issued: Dec. 22, 1981.
- U.S. Pat. No. 4,352,143, Patentee: Uno, Issued Sept. 28, 1982.
- U.S. Pat. No. 4,494,166, Patentee: Billings et al., Issued: Jan. 15, 1985.
- U.S. Pat. No. 4,553,191, Patentee: Franks et al., Issued: Nov. 12, 1985.

The relevant portions of the foregoing patents may be summarized as follows:

Nishikawa discloses a charge neutralizer including a brush made of thin conductive wires brought close to a charged body for discharge without contacting.

Uno describes a device for discharging static electricity using a plurality of electrodes made from stainless steel fibers bonded in a linear array of thermoplastic film.

Billings et al. discloses an electrophotographic printing machine with a static elimination system using at least two grounded carbon fiber brushes mounted in a plastic baffle assembly that inductively discharges static electricity from printed sheets. One brush contacts the sheet while the other brush is spaced therefrom to minimize fluctuations in static discharge over machine life.

Franks, Jr. et al. describes an electrophotographic printing machine having a static eliminator including a plurality of resilient, flexible thin fibers arranged in a linear array of spaced bundles held in a conductive support holder.

In accordance with one aspect of the present invention, there is provided a device for electrically grounding a member. The device includes a support member having a multiplicity of fibers mounted thereon. The support member has a plurality of spaced regions of reduced thickness to facilitate breaking said support member into separate members of user selectable length at the region of reduced thickness. In this way, the length of the support member corresponds to the length required to electrically ground the member.

Pursuant to another aspect of the features of the present invention, there is provided an electrophotographic printing machine of the type having a device for electrically grounding at least one component employed therein. The device includes a support member having a multiplicity of fibers mounted thereon and arranged to have the free end thereof extending toward the component being electrically grounded The support member has a plurality of spaced regions of a reduced thickness to facilitate breaking the support member into separate members of user selectable length at the region of reduced thickness. In this manner, the length of the support member corresponds to the length required to electrically ground the component Other aspects of the present invention will become apparent as the following description proceeds and upon reference to the drawings, in which:

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
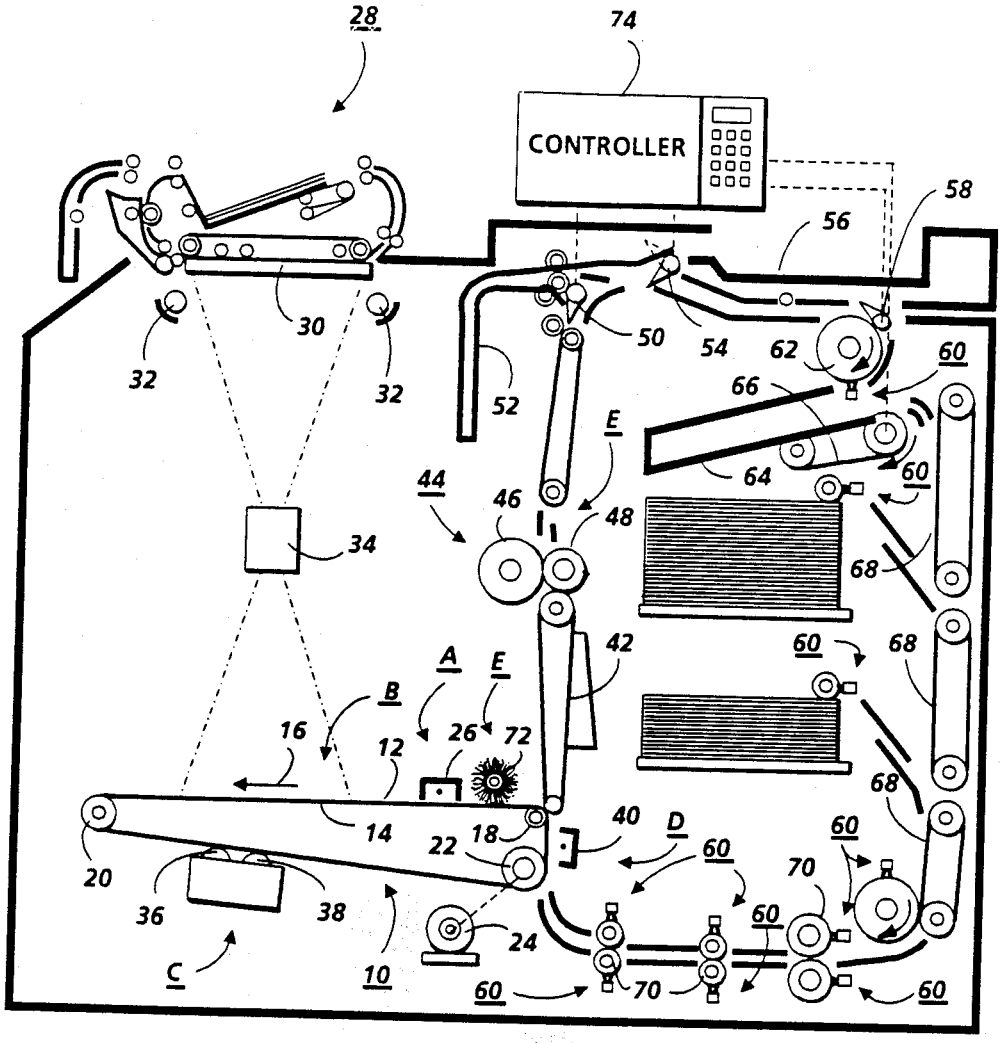
FIG. 1 is a schematic elevational view depicting an illustrative electrophotographic printing machine incorporating the electrical grounding brush of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the grounding brush of the present invention may be employed in a wide variety of devices and is not specifically limited in its application to the particular embodiment depicted herein.

Referring to FIG. 1 of the drawings, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive materials and conductive substrates may also be employed. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive surface 12 passes through charging station A. At charging station A, a corona generating device, indicated generally by the reference 26 charges photoconductive surface 12 to a relatively high, substantially uniform potential.

Next, the charged portion of photoconductive surface 12 is advanced through imaging station B. At imaging station B, a document handling unit, indicated generally by the reference numeral 28, is positioned over platen 30 of the printing machine. Document handling unit 28 sequentially feeds documents from a stack of documents placed by the operator face up in a normal forward collated order in the document stacking and holding tray. A document feeder located below the tray forwards the bottom document in the stack to a pair of take-away rollers. The bottom document is then fed by the rollers through a document guide to a feed roll pair and belt. The belt advances the document to platen 30. After imaging, the original documents is fed from platen 30 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 32 which illuminate the document on platen 30. Light rays reflected from the document are transmitted through lens 34. Lens 34 focuses light images of the original document onto the charged portion of photoconductive surface 12 of belt 10 to selectively dissipate the charge thereon. This records an electrostatic latent image on photoconductive surface 12 which corresponds to the informational areas contained within the original document. Thereafter, belt 10 advances the electrostatic latent image recorded on photoconductive surface 12 to development station C.

At development station C, a pair of magnetic brush developer rolls, indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

At transfer station D, a copy sheet is moved into contact with the toner powder image. Transfer station D includes a corona generating device 40 which sprays ions onto the backside of the copy sheet. This attracts the toner powder image from photoconductive surface 12. After transfer, conveyor 42 advances the copy sheet to fusing station E.

Fusing station E includes a fuser assembly, indicated generally by the reference numeral 44 which permanently affixes the transferred toner powder image to the copy sheet. Preferably, fuser assembly 44 includes a heated fuser roller 46 and a back-up roller 48 with the powder image on the copy sheet contacting fuser roller 46. In this manner, the powder image is permanently affixed to the copy sheet.

After fusing, the copy sheets are fed to gate 50 which functions as an inverter selector. Depending upon the position of gate 50, the copy sheets are deflected to sheet inverter 52 or bypass inverter 52 and are fed directly to a second decision gate 54. At gate 54, the sheet is in a face-up orientation with the image side, which has been fused, face up. If inverter path 52 is selected, the opposite is true, i.e. the last printed side is face down. Decision gate 54 either deflects the sheet directly into an output tray 56 or deflects the sheet to decision gate 58. Decision gate 58 may divert successive copy sheets to duplex inverter roll 62, or onto a transport path to a finishing station (not shown). When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side an on which an image will be subsequently printed on the second, opposed side thereof, i.e. the sheets being duplexed. The sheets are stacked in the duplex tray face down on top of one another in the order in which they are copied.

In order to complete duplex copying, the simplex sheets in tray 64 are fed, in seriatim, by bottom feeder 66 from tray 64 back to transfer station D via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or to be advanced to the finishing station.

A grounding brush, indicated generally by the reference numeral 60, incorporating the features of the present invention, is positioned in contact with the various rolls and shafts of the printing machine. As an example, grounding brush 60 is shown contacting inverter roll 62 and rollers 70. However, in actual practice, grounding brush 60 will be positioned in contact with all of the appropriate shafts and rollers in the printing machine. Thus, not only will grounding brush 60 electrically ground the drive rollers and shafts associated with the copy sheet drive systems, but also those associated with the original document handling system, i.e. document handling system 28. The support member of each grounding brush 60 is mounted on the electrically grounded machine frame with the brush extending outwardly therefrom in contact with the appropriate roll or shaft.

With continued reference to FIG. 1, invariably, after the copy sheet is separated from photoconductive surface 12 of belt 10, some residual particles remain adhering thereto. These residual particles are removed from photoconductive surface 12 at cleaning station F. Cleaning station F includes a rotatably mounted fibrous or electrostatic brush 72 in contact with photoconductive surface 12 of belt 10. The particles are cleaned from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, controller 74 regulates the various positions of the decision gates depending upon the mode of operation selected. The detailed construction of grounding brush 60 will be described hereinafter with reference to FIGS. 2 through 4, inclusive.

Figure 2:
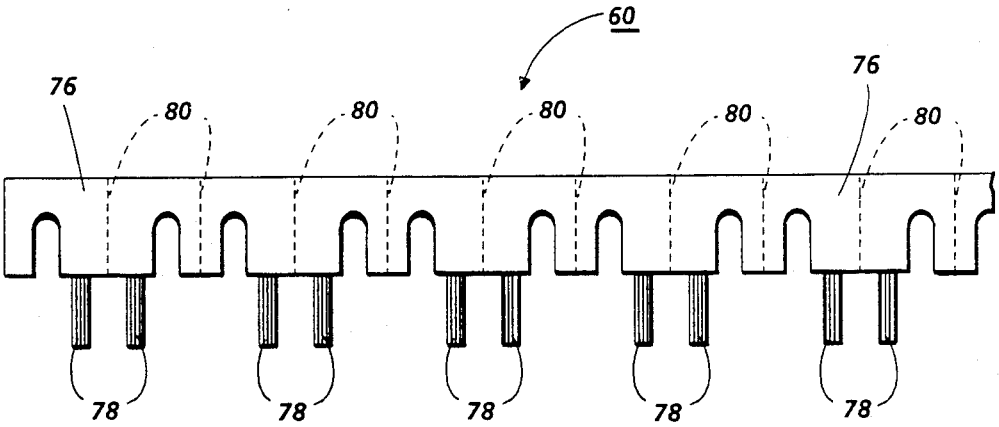
FIG. 2 is a schematic elevational view showing the electrical grounding brush assembly used in the FIG. 1 printing machine.

Referring now to FIG. 2, grounding brush 60 includes a support 76 having a linear array of spaced, discrete bundles of fibers 78 mounted thereon. Support 76 is an elongated substantially flat generally planar member having regions of reduced thickness, i.e. notches or break lines, 80 formed therein. The distance between adjacent regions 80 is about fifteen millimeters. Each bundle of fibers 78 includes from fifty to one thousand fibers. Each fiber has a diameter ranging from about five to about fifty microns. The fibers are electrically conductive and mounted on support 76 to have a free end extending outwardly therefrom toward the member of the printing machine to be electrically grounded. The fibers extend outwardly from support 76 over an effective length of about twelve millimeters, and exhibit a sufficient resiliency and stiffness, as well as high wear resistance to be used for a long period of time without distortion or deflection to preserve an excellent electrical discharging performance over extended periods of time. Preferably, the fibers of each bundle 78 are made from stainless steel or carbon. Support 76 is made from an electrically conductive plastic material. Preferably, support 76 is made from a conductive resin containing conductive particles. The length of grounding brush 60 is user selectable. The user determines the required brush length and breaks the support member at the appropriate notch or break line 80. Thus, a single continuous grounding brush may be broken by the user at the desired location to obtain a plurality of variable length grounding brushes.

Figure 3:
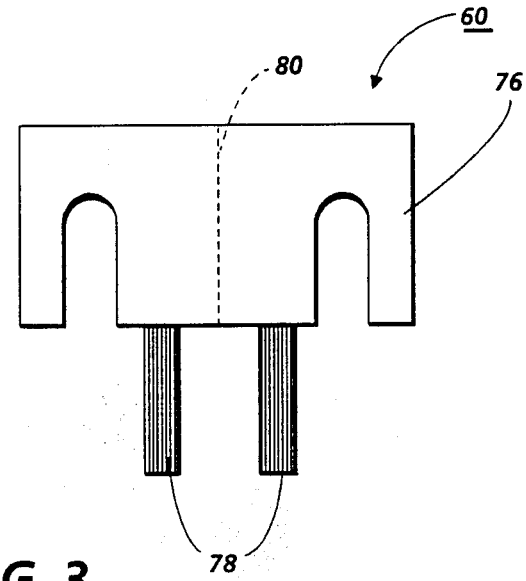
FIG. 3 is an elevational view depicting two brushes of the FIG. 2 electrical grounding brush assembly.

Turning now to FIG. 3, there is shown a grounding brush 60 having two bundles of fibers 78 extending outwardly from support 76. A grounding brush of this type is suitable for electrically grounding a roller or shaft. If desired, the user could further break grounding brush 60 into two grounding brushes by breaking it along notch or break line 80. A grounding brush having only one bundle of fibers 78 extending outwardly from support 76 is suitable for electrically grounding a shaft.

Figure 4:
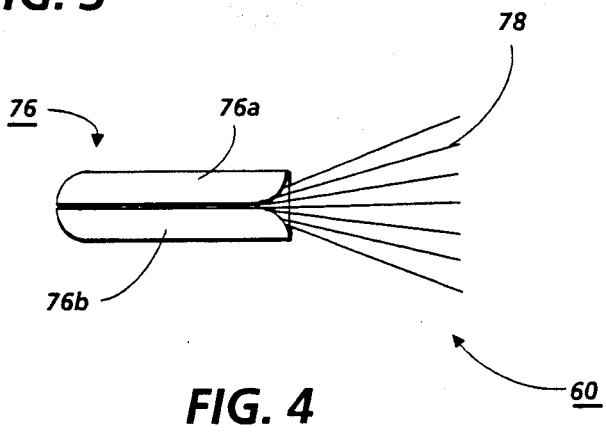
FIG. 4 is a top elevational view showing one brush of the FIG. 2 electrical grounding brush assembly.

FIG. 4 illustrates the manner in which grounding brush 60 is constructed. As depicted thereat, Support 76 includes a pair of generally planar flat members **76*a* and 76*b*. The bundles of fibers 78 are positioned between members 76*a* and 76*b*. Members 76*a* and 76*b* are secured to one another and fibers 78 by ultrasonic welding. Alternatively, members 76*a* and 76*b* may be secured to one another and fibers 78** by an electrically conductive adhesive, such as a graphite filled epoxy in a toluene xylene solvent made by Acheson Colloids Company of Port Huron, Mich. as Electrodag 213.

In recapitulation, the grounding brush brush of the present invention includes a plurality of spaced bundles of fibers arranged in a linear array on a support. The support has a plurality of spaced notches or break lines therein interposed between adjacent bundles of fibers. This enables the user to select the desired grounding brush length and break the support at the corresponding notch or break line. A grounding brush constructed in this manner is significantly less expensive to employ in a printing machine. For example, a brush of this type is from seventy five to eighty percent less expensive than grounding brushes heretofore constructed in a conventional manner.

It is, therefore, evident that there has been provided, in accordance with the present invention, a grounding brush that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A device for electrically grounding a member, including:

a support member; and a multiplicity of fibers mounted on said support member, said support member having a plurality of spaced regions of a reduced thickness to facilitate breaking said support member into separate members of user selectable length at the region of reduced thickness so that the length of said support member corresponds to the length required to electrically ground the member.

2. A device according to claim 1, wherein said multiplicity of fibers are arranged in a linear array of spaced, discrete bundles of fibers on said support member.

3. A device according to claim 2, wherein said support member is an elongated, substantially flat, planar member.

4. A device according to claim 3, wherein one of the regions of reduced thickness is interposed between each adjacent one of said bundles of fibers.

5. A device according to claim 4, wherein the regions of reduced thickness are substantially equally spaced notches in the surface of said planar member.

6. A device according to claim 5, wherein said planar member is made from an electrically conductive material.

7. A device according to claim 6, wherein said fibers are made from an electrically conductive material.

8. An electrophotographic printing machine of the type having a device for electrically grounding at least one component employed therein, including a support member; and a multiplicity of fibers mounted on said support member and arranged to have the free end thereof extending toward the component being electrically grounded, said support member having a plurality of spaced regions of a reduced thickness to facilitate breaking said support member into separate members of user selectable length at the region of reduced thickness so that the length of said support member corresponds to the length required to electrically ground the component.

9. A printing machine according to claim 8, wherein said multiplicity of fibers are arranged in a linear array of spaced, discrete bundles of fibers on said support member.

10. A printing machine according to claim 9, wherein said support member is an elongated, substantially flat, planar member.

11. A printing machine according to claim 10, wherein one of the regions of reduced thickness is interposed between each adjacent one of said bundles of fibers.

12. A printing machine according to claim 11, wherein the regions of reduced thickness are substantially equally spaced notches in the surface of said planar member.

13. A printing machine according to claim 12, wherein said planar member is made from an electrically conductive material.

14. A printing machine according to claim 13, wherein said fibers are made from an electrically conductive material.

* * * * *